US008089214B2

(12) United States Patent
Terashima et al.

(10) Patent No.: US 8,089,214 B2
(45) Date of Patent: Jan. 3, 2012

(54) DRIVING METHOD AND DRIVING DEVICE FOR DISCHARGE LAMP, LIGHT SOURCE DEVICE, AND IMAGE DISPLAY DEVICE

(75) Inventors: Tetsuo Terashima, Chino (JP); Kentaro Yamauchi, Ashiya (JP); Takeshi Takezawa, Matsumoto (JP); Kazuo Okawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 472 days.

(21) Appl. No.: 12/389,648

(22) Filed: Feb. 20, 2009

(65) Prior Publication Data

US 2009/0212714 A1 Aug. 27, 2009

(30) Foreign Application Priority Data

Feb. 21, 2008 (JP) ..... 2008-039910

(51) Int. Cl.
*H05B 41/36* (2006.01)
*H05B 41/24* (2006.01)

(52) U.S. Cl. ..... 315/287; 315/209 R; 315/246

(58) Field of Classification Search ..... 315/287, 315/209 R, 246, 307, 291; 345/212
See application file for complete search history.

(56) References Cited

U.S. PATENT DOCUMENTS 6,232,728 B1 * 5/2001 Yamamoto et al. ..... 315/307
6,815,907 B2 11/2004 Riederer

FOREIGN PATENT DOCUMENTS

JP 2004-525496 T 8/2004
WO WO-02/091806 11/2002

* cited by examiner

*Primary Examiner* — Daniel D Chang
(74) *Attorney, Agent, or Firm* — AdvantEdge Law Group, LLC

(57) ABSTRACT

A driving method for a discharge lamp that lights by performing discharge between two electrodes while alternately switching a polarity of a voltage applied between the two electrodes includes: modulating an anode duty ratio, which is a ratio of an anode time for which one of the electrodes operates as an anode in one period of the polarity switching, within a predetermined range; and changing the predetermined range to make a maximum value of the modulated anode duty ratio higher than a maximum value of an initial anode duty ratio of the discharge lamp when a predetermined condition is satisfied.

11 Claims, 19 Drawing Sheets

TIP OF DISCHARGE ELECTRODE IN INITIAL STATE

TIP OF DISCHARGE ELECTRODE THAT HAS DETERIORATED

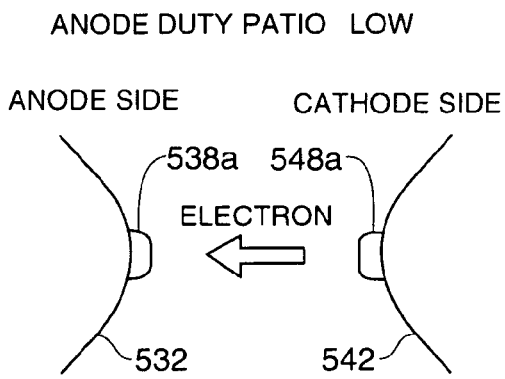
FIG. 14A
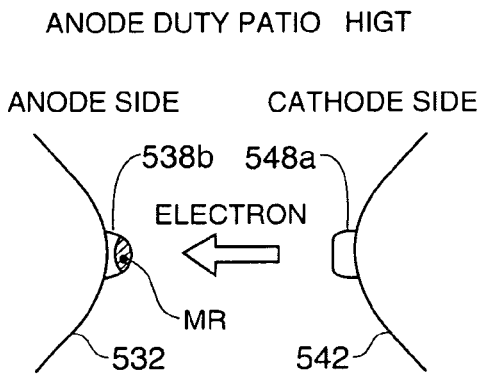
FIG. 14B
FIG. 14C
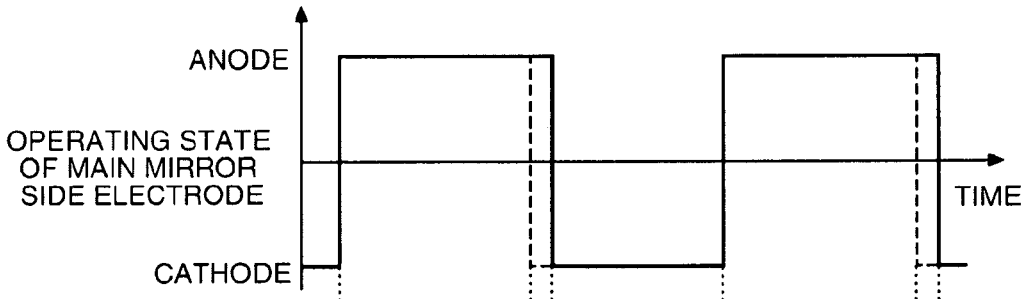
FIG. 14D
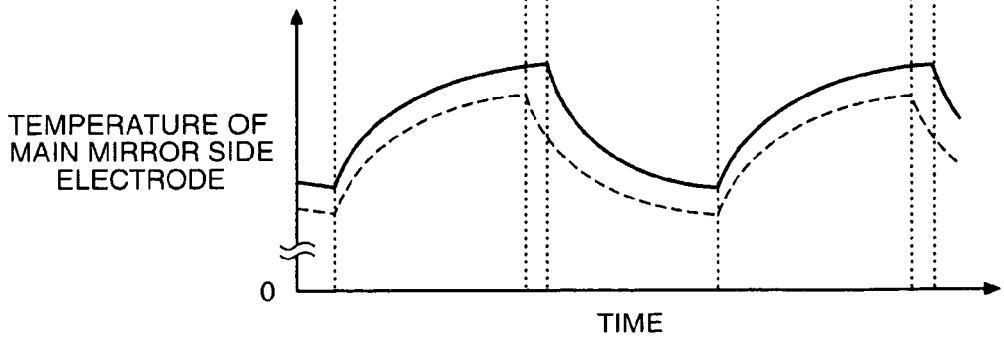

DRIVING METHOD AND DRIVING DEVICE FOR DISCHARGE LAMP, LIGHT SOURCE DEVICE, AND IMAGE DISPLAY DEVICE

BACKGROUND

1. Technical Field

The present invention relates to a technique of driving a discharge lamp that lights by discharge between electrodes.

2. Related Art

A high-intensity discharge lamp, such as a high-pressure gas discharge lamp, is used as a light source for an image display device, such as a projector. As a method of making the high-intensity discharge lamp light, an alternating current (AC lamp current) is supplied to the high-intensity discharge lamp. Thus, in order to improve the stability of light arc occurring within a high-intensity discharge lamp when supplying an AC lamp current to make the high-intensity discharge lamp light, JP-T-2004-525496 proposes to supply to the high-intensity discharge lamp an AC lamp current which has an almost constant absolute value and of which a pulse width ratio between a pulse width of a positive pulse and a pulse width of a negative pulse is modulated.

However, even if the high-intensity discharge lamp is made to light by performing pulse width modulation of the AC lamp current, it may be difficult to stabilize the light arc depending on a state of an electrode of the high-intensity discharge lamp, for example, in a case where a discharge electrode has deteriorated. This problem is not limited to the high-intensity discharge lamp but is common in various kinds of discharge lamps that emit light by arc discharge between electrodes.

SUMMARY

An advantage of some aspects of the invention is to make a discharge lamp light more stably.

According to an aspect of the invention, a driving method for a discharge lamp that lights by performing discharge between two electrodes while alternately switching a polarity of a voltage applied between the two electrodes includes: modulating an anode duty ratio, which is a ratio of an anode time for which one of the electrodes operates as an anode in one period of the polarity switching, within a predetermined range; and changing the predetermined range to make a maximum value of the modulated anode duty ratio higher than a maximum value of an initial anode duty ratio of the discharge lamp when a predetermined condition is satisfied.

According to the aspect of the invention, when the predetermined condition is satisfied, the maximum value of the anode duty ratio is set to be higher than the initial anode duty ratio. By setting the anode duty ratio high, the temperature of the tip of the electrode at which discharge occurs rises. Then, the tip of the electrode melts to form a dome-like projection. The arc between the electrodes of the discharge lamp generally occurs from the projection formed as described above. Accordingly, since the arc occurrence position is stabilized, the discharge lamp lights more stably.

In the driving method for a discharge lamp described above, preferably, a change width of the anode duty ratio per change of the anode duty ratio is constant in the modulation of the anode duty ratio. In addition, preferably, when the predetermined condition is satisfied, the maximum value of the anode duty ratio is increased by increasing the number of times of change for increasing the anode duty ratio in one modulation period for which the modulation is performed.

In this case, the maximum value of the anode duty ratio is increased by increasing the number of times of change of anode duty ratio for increasing the anode duty ratio in one modulation period when modulating the anode duty ratio. Accordingly, in a state where the maximum value of the anode duty ratio is higher, a time taken for the anode duty ratio to reach the maximum value can be shortened. As a result, since an excessive temperature increase in the electrode can be suppressed, deterioration of the electrode can be suppressed.

In the driving method for a discharge lamp described above, preferably, the discharge lamp has a condition in which an operating temperature of one of the two electrodes is higher than that of the other electrode, and an anode duty ratio in the one electrode is set to be lower than that in the other electrode.

In this case, the anode duty ratio in the one electrode whose operating temperature increases is set to be lower than that in the other electrode. Accordingly, since the excessive temperature increase in the electrode whose operating temperature increases is suppressed, deterioration of the electrode can be suppressed.

In this case, preferably, the discharge lamp has a reflecting mirror that reflects light emitted between the electrodes toward the other electrode side.

By providing the reflecting mirror, heat radiation from the electrode on a side at which the reflecting mirror is provided can be prevented. In this case, since the excessive temperature increase in the electrode, from which heat radiation is prevented as described above, is suppressed, deterioration of the electrode on the reflecting mirror side can be suppressed.

In the driving method for a discharge lamp described above, preferably, the predetermined condition is satisfied when a cumulative lighting time of the discharge lamp exceeds a predetermined reference time.

In this case, when the cumulative lighting time of the discharge lamp exceeds the reference time, the anode duty ratio is set to be higher. Therefore, formation of a projection is accelerated for the electrode that has deteriorated due to the long cumulative lighting time, and an excessive temperature increase is suppressed for the electrode that has not deteriorated yet because the cumulative lighting time is short. As a result, deterioration of the electrode can be suppressed, and a drop in the stability of arc caused by deterioration of the electrode can be suppressed.

In the driving method for a discharge lamp described above, it is preferable to further include: detecting a deterioration state of the electrode according to the use of the discharge lamp; and determining whether or not the predetermined condition is satisfied on the basis of the deterioration state.

In this case, the anode duty ratio is set to be higher on the basis of the deterioration state of the electrode. Therefore, formation of a projection is accelerated for the electrode that has deteriorated, and an excessive temperature increase is suppressed for the electrode that has not deteriorated yet. As a result, deterioration of the electrode can be suppressed, and a drop in the stability of arc caused by deterioration of the electrode can be suppressed.

In this case, preferably, the deterioration state is detected on the basis of a voltage applied between the two electrodes in supplying predetermined power between the two electrodes.

In general, when the electrode deteriorates, the arc length increases. As a result, a voltage applied in supplying the predetermined power rises. Therefore, according to the driving method described above, the deterioration state of the electrode can be detected more easily.

In the driving method for a discharge lamp described above, preferably, the period of the polarity switching is maintained as a constant value within one modulation period for which the modulation is performed.

In this case, the polar switching period is maintained as a constant value within the modulation period. Therefore, since the anode duty ratio can be modulated by a typical pulse width modulation circuit, it becomes easier to modulate the anode duty ratio.

In addition, the invention may also be realized in various forms. For example, the invention may be realized as a driving device for a discharge lamp, a light source device using a discharge lamp and a control method thereof, and an image display device using the light source device.

BRIEF DESCRIPTION OF THE DRAWINGS

The invention will be described with reference to the accompanying drawings, wherein like numbers reference like elements.

FIGS. 14A to 14D are explanatory views illustrating how a change in the anode duty ratio affects a discharge electrode.

DESCRIPTION OF EXEMPLARY EMBODIMENTS

Hereinafter, an embodiment of the invention will be described through examples in the following order.

A. First example

B. Second example

C. Modifications

A. First Example

Figure 1:
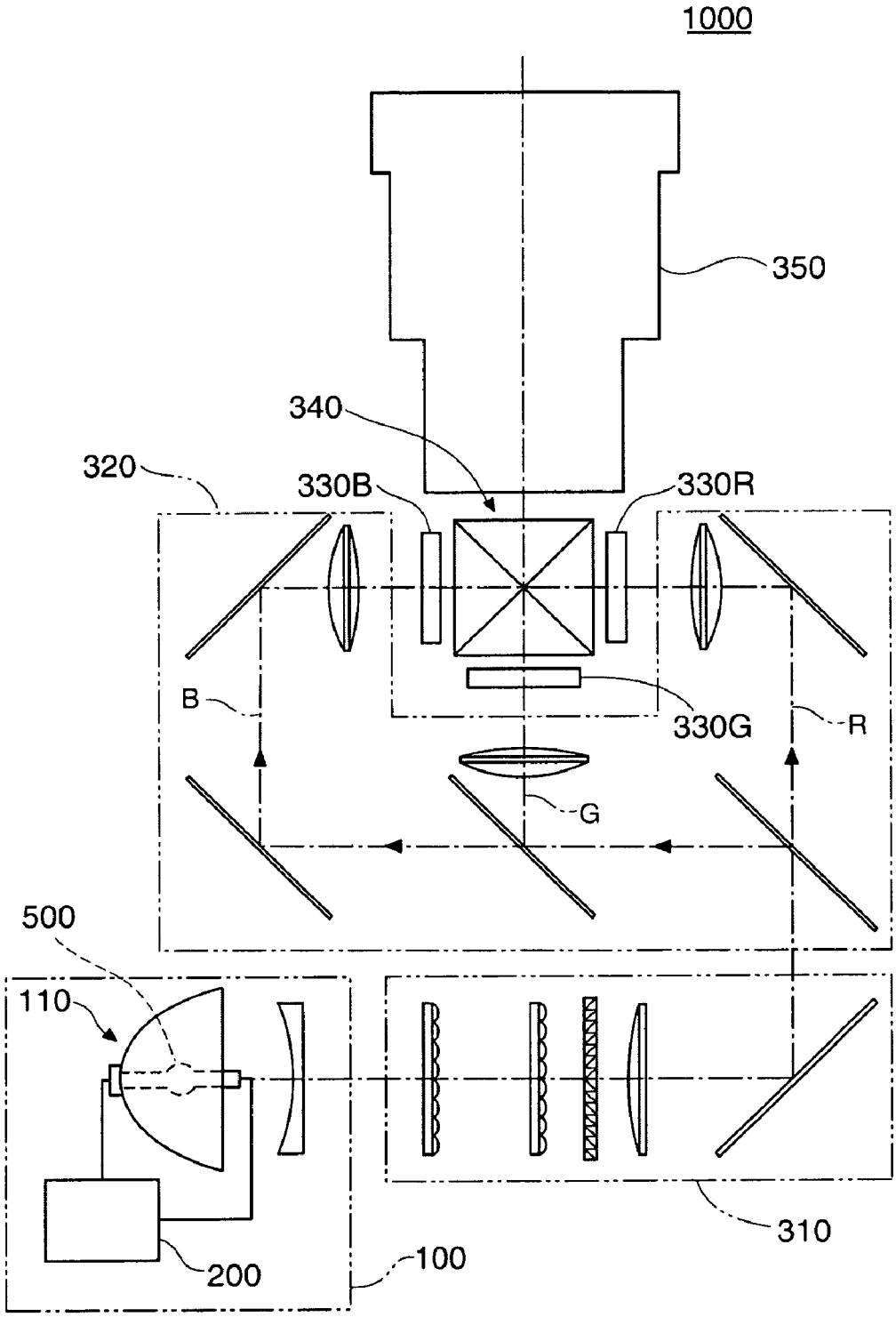
FIG. 1 is a schematic view illustrating the configuration of a projector in a first example of the invention.

FIG. 1 is a schematic view illustrating the configuration of a projector 1000 in a first example of the invention. The projector 1000 includes a light source device 100, an illumination optical system 310, a color separation optical system 320, three liquid crystal light valves 330R, 330G, and 330B, a cross dichroic prism 340, and a projection optical system 350.

The light source device 100 has a light source unit 110 to which a discharge lamp 500 is attached and a discharge lamp driving device 200 that drives the discharge lamp 500. The discharge lamp 500 receives power from the discharge lamp driving device 200 to emit light. The light source unit 110 emits discharged light of the discharge lamp 500 toward the illumination optical system 310. In addition, the specific configurations and functions of the light source unit 110 and discharge lamp driving device 200 will be described later.

The light emitted from the light source unit 110 has uniform illuminance by the illumination optical system 310, and the light emitted from the light source unit 110 is polarized in one direction by the illumination optical system 310. The light which has the uniform illuminance and is polarized in one direction through the illumination optical system 310 is separated into color light components with three colors of red (R), green (G), and blue (B) by the color separation optical system 320. The color light components with three colors separated by the color separation optical system 320 are modulated by the corresponding liquid crystal light valves 330R, 330G, and 330B, respectively. The color light components with three color modulated by the liquid crystal light valves 330R, 330G, and 330B are mixed by the cross dichroic prism 340 to be then incident on the projection optical system 350. When the projection optical system 350 projects the incident light onto a screen (not shown), an image as a full color image in which images modulated by the liquid crystal light valves 330R, 330G, and 330B are mixed is displayed on the screen. In addition, although the color light components with the three colors are separately modulated by the three liquid crystal light valves 330R, 330G, and 330B in the first example, modulation of light may also be performed by one liquid crystal light valve provided with a color filter. In this case, the color separation optical system 320 and the cross dichroic prism 340 may be omitted.

Figure 2:
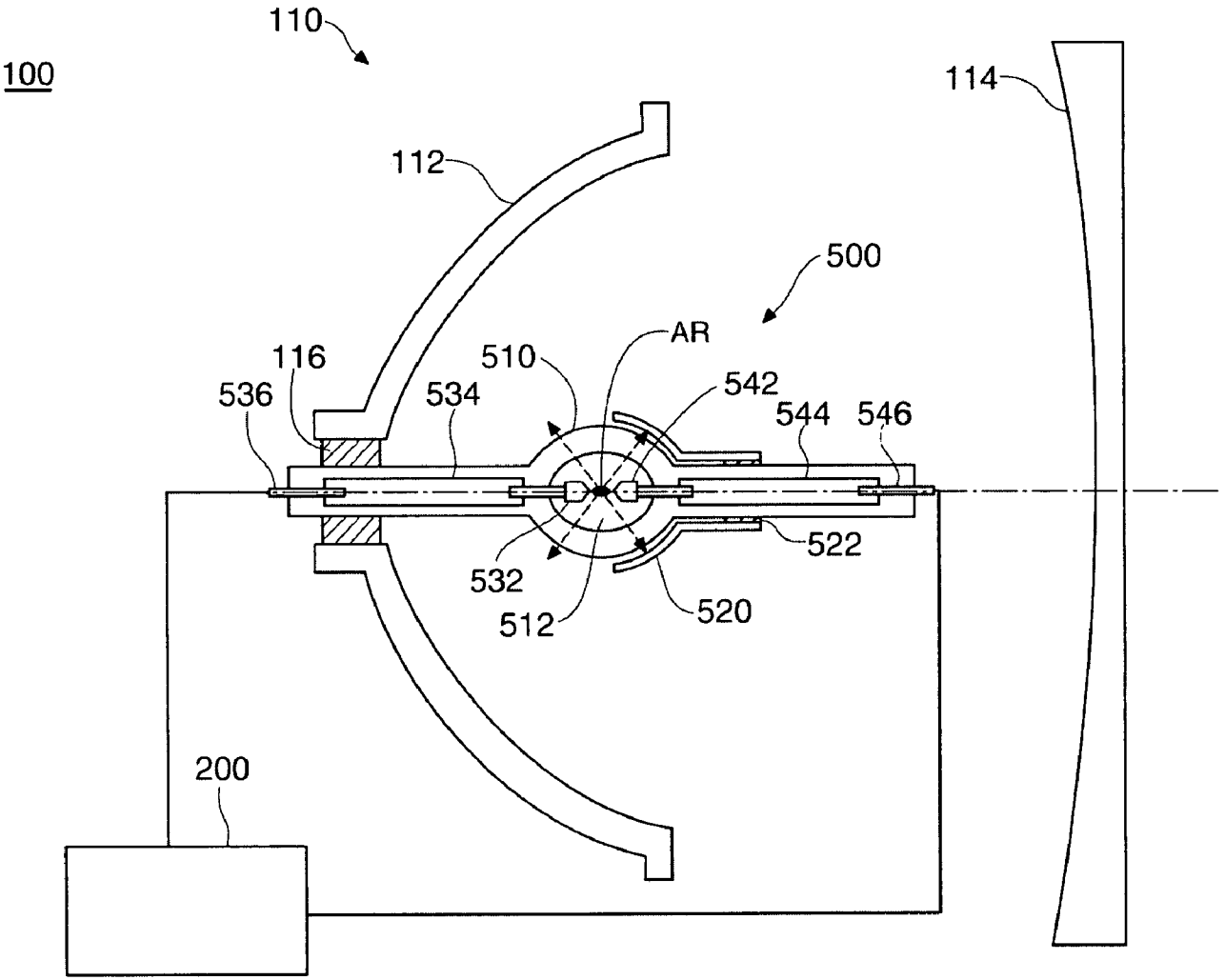
FIG. 2 is an explanatory view illustrating the configuration of a light source device.

FIG. 2 is an explanatory view illustrating the configuration of the light source device 100. The light source device 100 has the light source unit 110 and the discharge lamp driving device 200 as described above. The light source unit 110 includes the discharge lamp 500, a main reflecting mirror 112 having a spheroidal reflecting surface, and a parallelizing lens 114 that makes emitted light almost parallel light beams. However, the reflecting surface of the main reflecting mirror 112 does not necessarily need to be a spheroidal shape. For example, the reflecting surface of the main reflecting mirror 112 may have a paraboloidal shape. In this case, the parallelizing lens 114 may be omitted if a light emitting portion of the discharge lamp 500 is placed on a so-called focal point of a paraboloidal mirror. The main reflecting mirror 112 and the discharge lamp 500 are bonded to each other with an inorganic adhesive 116.

The discharge lamp 500 is formed by bonding a discharge lamp body 510 and an auxiliary reflecting mirror 520, which has a spherical reflecting surface, with an inorganic adhesive 522. The discharge lamp body 510 is formed of a glass material, such as quartz glass. Two discharge electrodes 532 and 542 formed of an electrode material using high-melting-point metal, such as tungsten, two connecting members 534 and 544, and two electrode terminals 536 and 546 are provided in the discharge lamp body 510. The discharge electrodes 532 and 542 are disposed such that tips thereof face each other in a discharge space 512 formed in the middle of the discharge lamp body 510. Rare gas or gas containing mercury or a metal halogen compound is injected as a discharge medium into the discharge space 512. The connecting member 534 is a member that electrically connects the discharge electrode 532 with the electrode terminal 536, and the connecting member 544 is a member that electrically connects the discharge electrode 542 with the electrode terminal 546.

The electrode terminals 536 and 546 of the discharge lamp 500 are connected to the discharge lamp driving device 200, respectively. The discharge lamp driving device 200 supplies a pulsed alternating current (AC pulse current) to the electrode terminals 536 and 546. When the AC pulse current is supplied to the electrode terminals 536 and 546, arc AR occurs between the tips of the two discharge electrodes 532 and 542 in the discharge space 512. The arc AR makes light emitted from the position, at which the arc AR has occurred, toward all directions. The auxiliary reflecting mirror 520 reflects light, which is emitted in a direction of one discharge electrode 542, toward the main reflecting mirror 112. The degree of parallelization of light emitted from the light source unit 110 can be further increased by reflecting the light emitted in the direction of the discharge electrode 542 toward the main reflecting mirror 112 as described above. Moreover, in the following description, the discharge electrode 542 on a side where the auxiliary reflecting mirror 520 is provided is also referred to as the 'auxiliary mirror side electrode 542', and the other discharge electrode 532 is also referred to as the 'main mirror side electrode 532'.

Figure 3:
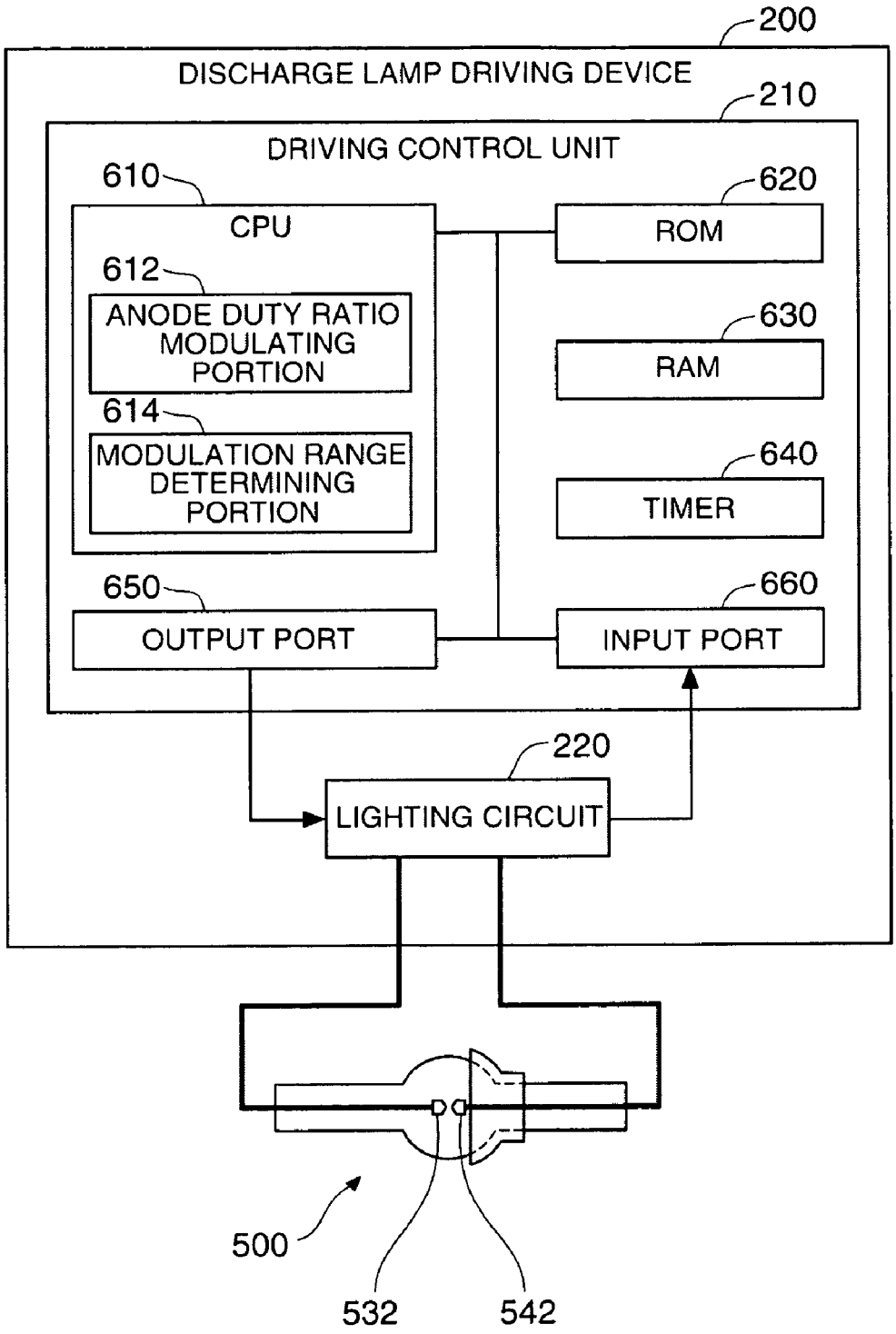
FIG. 3 is a block diagram illustrating the configuration of a discharge lamp driving device.

FIG. 3 is a block diagram illustrating the configuration of the discharge lamp driving device 200. The discharge lamp driving device 200 has a driving control unit 210 and a lighting circuit 220. The driving control unit 210 functions as a computer including a CPU 610, a ROM 620 and a RAM 630, a timer 640, an output port 650 for outputting a control signal to the lighting circuit 220, and an input port 660 for acquiring a signal from the lighting circuit 220. The CPU 610 of the driving control unit 210 executes a program stored in the ROM 620 on the basis of an output of the timer 640. Thus, the CPU 610 realizes a function of an anode duty ratio modulating portion 612 and a function of a modulation range determining portion 614. In addition, the functions of the anode duty ratio modulating portion 612 and modulation range determining portion 614 will be described later.

The lighting circuit 220 has an inverter 222 that generates an AC pulse current. The lighting circuit 220 supplies an AC pulse current with constant power (for example, 200 W) to the discharge lamp 500 by controlling the inverter 222 on the basis of a control signal supplied from the driving control unit 210 through the output port 650. Specifically, the lighting circuit 220 controls the inverter 222 to generate an AC pulse current corresponding to power supply conditions (for example, a frequency, a duty ratio, and a current waveform of the AC pulse current) designated by the control signal in the inverter 222. The lighting circuit 220 supplies the AC pulse current generated by the inverter 222 to the discharge lamp 500.

Figure 4:
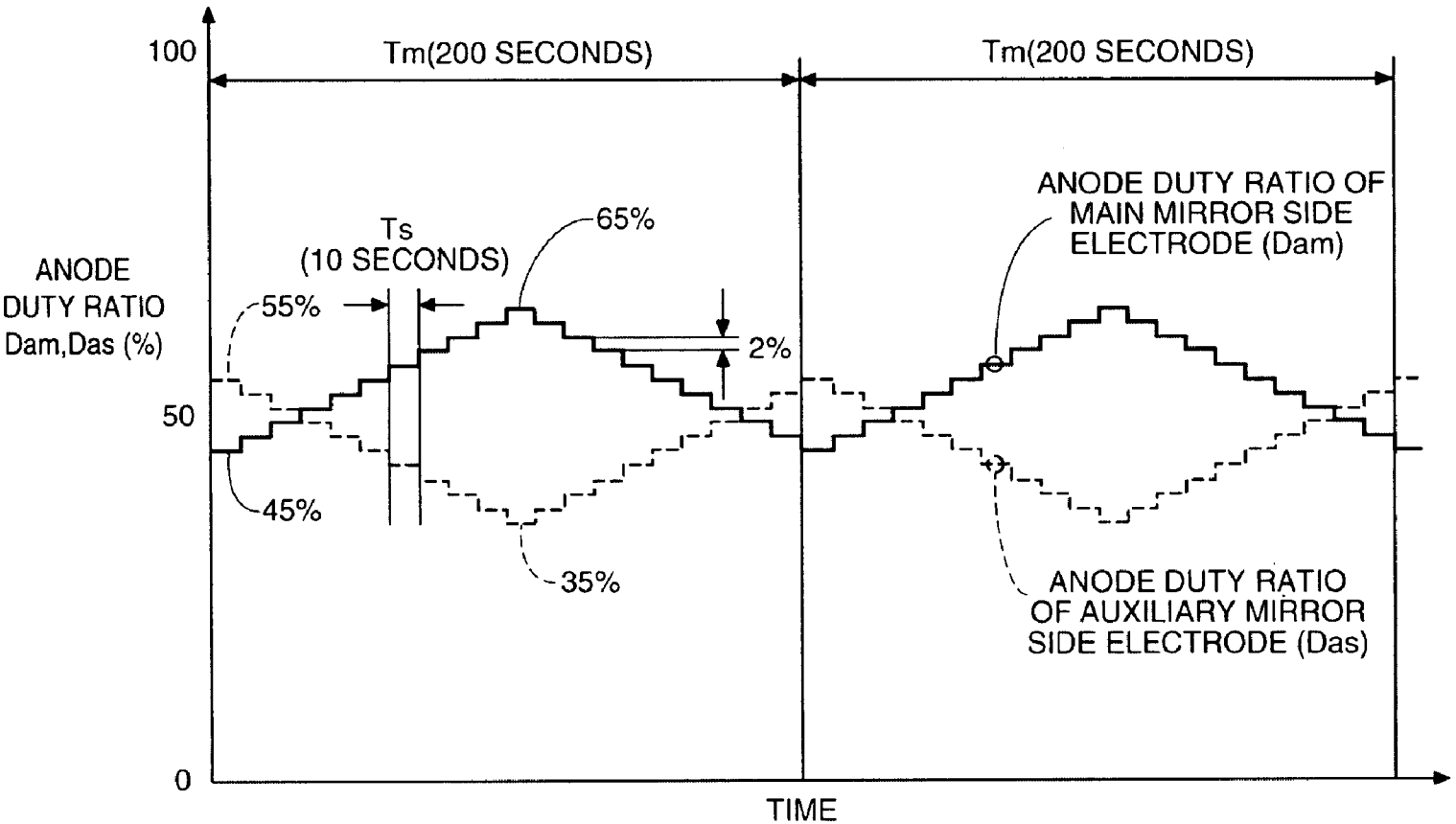
FIG. 4 is an explanatory view illustrating how a duty ratio of an AC pulse current is modulated.

The anode duty ratio modulating portion 612 of the driving control unit 210 modulates the duty ratio of the AC pulse current within a modulation period (for example, 200 seconds) set beforehand. FIG. 4 is an explanatory view illustrating how the duty ratio of the AC pulse current is modulated. The graph of FIG. 4 shows temporal changes of anode duty ratios Dam and Das. Here, the anode duty ratios Dam and Das are ratios of time (anode time), for which the two electrodes 532 and 542 operate as anodes, to one period of the AC pulse current, respectively. In the graph of FIG. 4, a solid line shows the anode duty ratio Dam of the main mirror side electrode 532, and a broken line shows the anode duty ratio Das of the auxiliary mirror side electrode 542.

In the example shown in FIG. 4, the anode duty ratio modulating portion 612 (FIG. 3) changes the anode duty ratios Dam and Das by a predetermined change width (2%) whenever a step time Ts (10 seconds) corresponding to 1/20 of a modulation period Tm (200 seconds) elapses. Thus, by modulating the anode duty ratios Dam and Das within the modulation period Tm, uneven deposition of an electrode material on an inner wall of the discharge space 512 (FIG. 2) can be suppressed. By suppressing the uneven deposition of the electrode material, it becomes possible to suppress abnormal discharge caused by a variation in the amount of light of the discharge lamp 500 or growth of needle-like crystal of the electrode material. Moreover, in the first example, the modulation period Tm is set to 200 seconds and the step time Ts is set to 10 seconds. In this case, the modulation period Tm and the step time Ts may be suitably changed on the basis of a characteristic, a power supply condition, and the like of the discharge lamp 500.

As is apparent from FIG. 4, in the first example, a maximum value of the anode duty ratio Dam of the main mirror side electrode 532 is set to be higher than that of the anode duty ratio Das of the auxiliary mirror side electrode 542. However, the maximum values of the anode duty ratios of the two discharge electrodes 532 and 542 do not necessarily need to be different. However, when the maximum values of the anode duty ratios are made high, the highest temperatures of the discharge electrodes 532 and 542 are increased as will be described later. On the other hand, when the discharge lamp 500 having the auxiliary reflecting mirror 520 is used as shown in FIG. 2, the heat from the auxiliary mirror side electrode 542 becomes difficult to be emitted. Therefore, it is more preferable to set the maximum value of the anode duty ratio Dam of the main mirror side electrode 532 higher than that of the anode duty ratio Das of the auxiliary mirror side electrode 542 from a point of view that an excessive temperature increase in the auxiliary mirror side electrode 542 can be suppressed. Moreover, in general, when the temperature of one of the discharge electrodes 532 and 534 becomes higher than that of the other one due to an influence of a cooling method or the like in driving the two discharge electrodes 532 and 542 in the same operating condition, it is more preferable to make the anode duty ratio of the one discharge electrode lower than that of the other one.

Furthermore, in the first example, the anode duty ratio Dam of the main mirror side electrode 532 increases for every step time Ts in the first half of the modulation period Tm and decreases for every step time Ts in the second half. However, the change pattern of the anode duty ratios Dam and Das is not necessarily limited thereto. For example, the anode duty ratio Dam of the main mirror side electrode 532 may be made to monotonically increase or monotonically decrease within the modulation period Tm. However, it is more preferable to make the amount of change in the anode duty ratios Dam and Das for every step time Ts constant as shown in FIG. 4 from a point of view that the thermal shock applied to the discharge lamp 500 can be reduced.

Figure 5A:
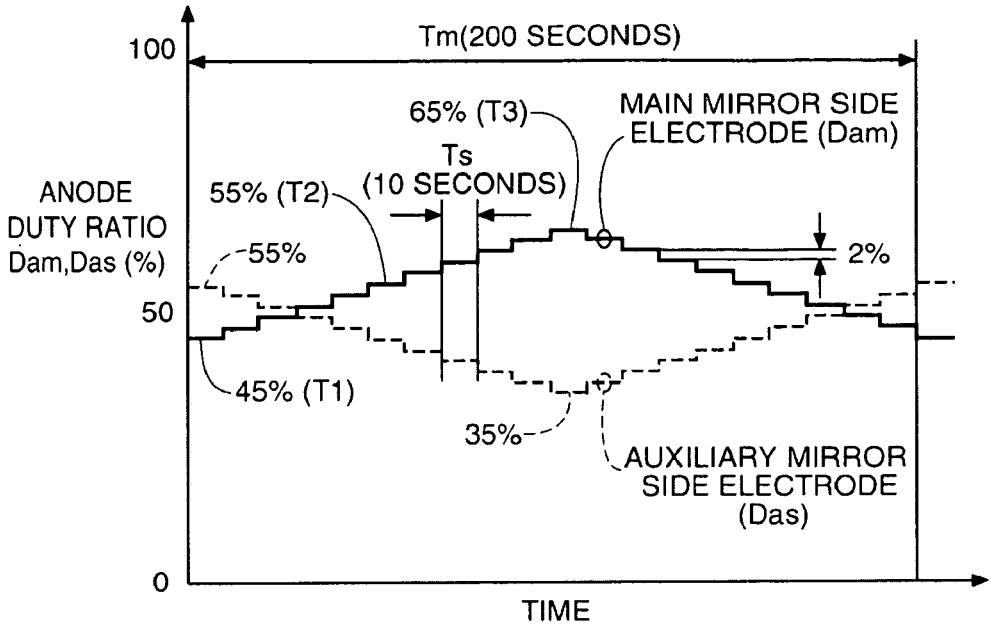
FIGS. 5A and 5B are explanatory views illustrating how the anode duty ratio is modulated to drive a discharge lamp.
Figure 5B:
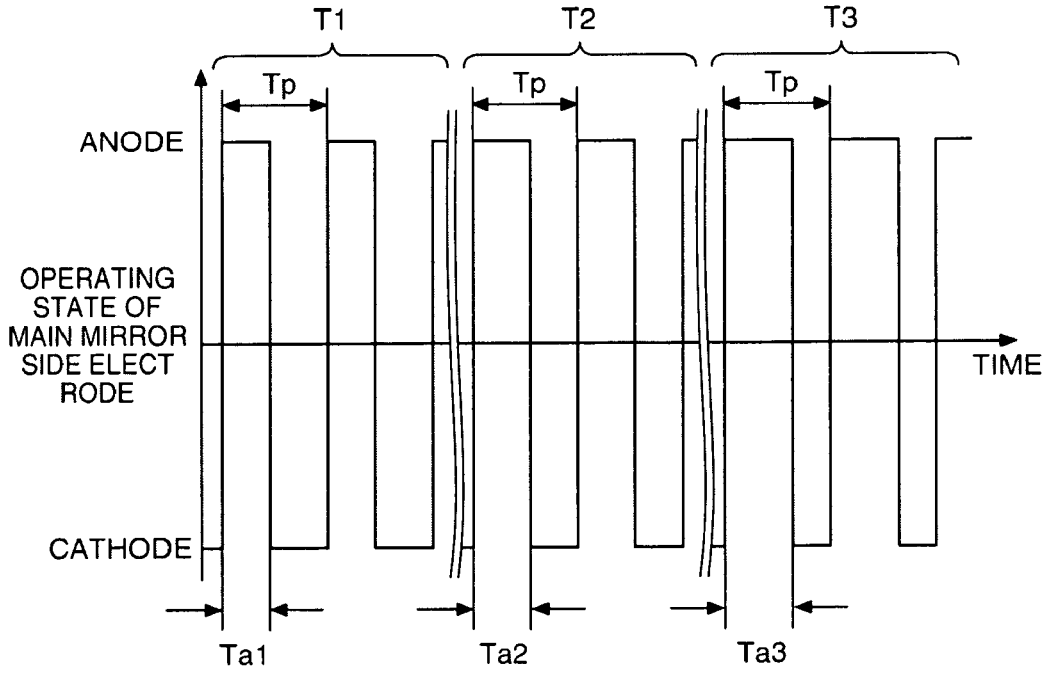

FIGS. 5A and 5B are explanatory views illustrating how the anode duty ratio is modulated to drive the discharge lamp 500. FIG. 5A is different from FIG. 4 in that temporal changes in the anode duty ratios Dam and Das are shown for only one modulation period (1 Tm). Since the other points are almost similar to those described in FIG. 4, an explanation thereof will be omitted. FIG. 5B is a graph illustrating a temporal change of an operating state of the main mirror side electrode 532 in three periods T1 to T3 in which the anode duty ratio Dam of the main mirror side electrode 532 in FIG. 5A is set to different values (45%, 55%, and 65%).

As shown in FIG. 5B, in all of the three periods T1 to T3 with the different anode duty ratios Dam, the switching period Tp in which the polarity of the main mirror side electrode 532 is switched is constant. Thus, in the first example, a frequency (f=1/Tp) of the AC pulse current is set to a fixed frequency (for example, 80 Hz) over the whole period of the modulation period Tm. On the other hand, anode times Ta1 to Ta3 of the main mirror side electrode 532 are set to different values in the periods T1 to T3 with the different anode duty ratios Dam. Thus, in the first example, modulation of the anode duty ratio Dam is performed by changing the anode time Ta while keeping the frequency f of the AC pulse current constant. In addition, the frequency f of the AC pulse current does not necessarily need to be constant. However, it is more preferable to make the frequency f of the AC pulse current constant from a point of view that the anode duty ratio can be modulated using a typical pulse width modulation circuit.

In the first example, the modulation range determining portion 614 (FIG. 3) of the driving control unit 210 changes a range of the anode duty ratio, which is set within the modulation period Tm (modulation range), on the basis of a deterioration state of the discharge lamp 500. Specifically, the CPU 610 acquires, through the input port 660, a lamp voltage as a parameter indicating the deterioration state of the discharge lamp 500. Here, the lamp voltage refers to a voltage between the discharge electrodes 532 and 542 when driving the discharge lamp 500 with constant power. The modulation range determining portion 614 determines a modulation range of the duty ratio on the basis of the lamp voltage (detection lamp voltage) acquired as described above. The CPU 610 controls the lighting circuit 220 such that the anode duty ratio is changed for every step time Ts on the basis of the modulation range determined by the modulation range determining portion 614. In addition, a method of determining a modulation range of the anode duty ratio using the modulation range determining portion 614 will be described later.

Figure 6A:
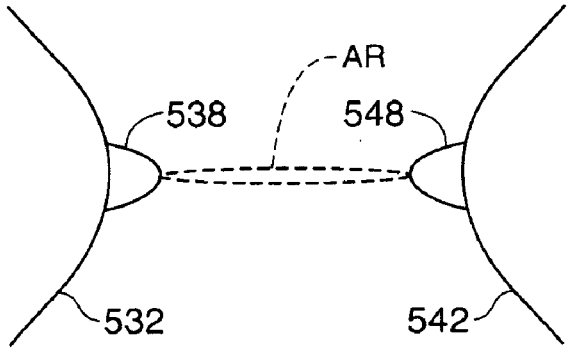
FIGS. 6A and 6B are explanatory views illustrating how a deterioration state of a discharge lamp is detected by a lamp voltage.
Figure 6B:
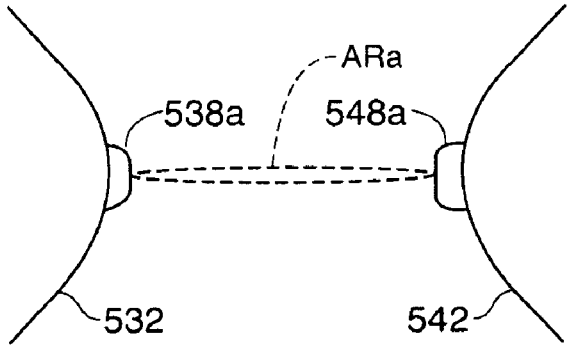

FIGS. 6A and 6B are explanatory views illustrating how the deterioration state of the discharge lamp 500 is detected by the lamp voltage. FIG. 6A illustrates the shapes of tips of the discharge electrodes 532 and 542 in an initial state. FIG. 6B illustrates the shapes of the tips of the discharge electrodes 532 and 542 in a state where the discharge lamp 500 has deteriorated. As shown in FIG. 6A, in the initial state, dome-like projections 538 and 548 are formed on the tips of the discharge electrodes 532 and 542 so as to protrude toward the opposite discharge electrodes, respectively.

In this case, the arc AR caused by discharge between the discharge electrodes 532 and 542 occurs between the two projections 538 and 548. As the discharge lamp 500 is used, electrode materials evaporate from the projections 538 and 548 and the tips of projections 538*a* and 548*a* become flat as shown in FIG. 6B. When the tips of the projections 538*a* and 548*a* become flat, the length of discharge arc ARa increases. As a result, a voltage between electrodes required to supply the same power, that is, a lamp voltage, rises. Thus, the lamp voltage rises gradually as the discharge lamp 500 deteriorates. Therefore, in the first example, the lamp voltage is used as a parameter indicating the deterioration state of the discharge lamp 500.

Figure 7:
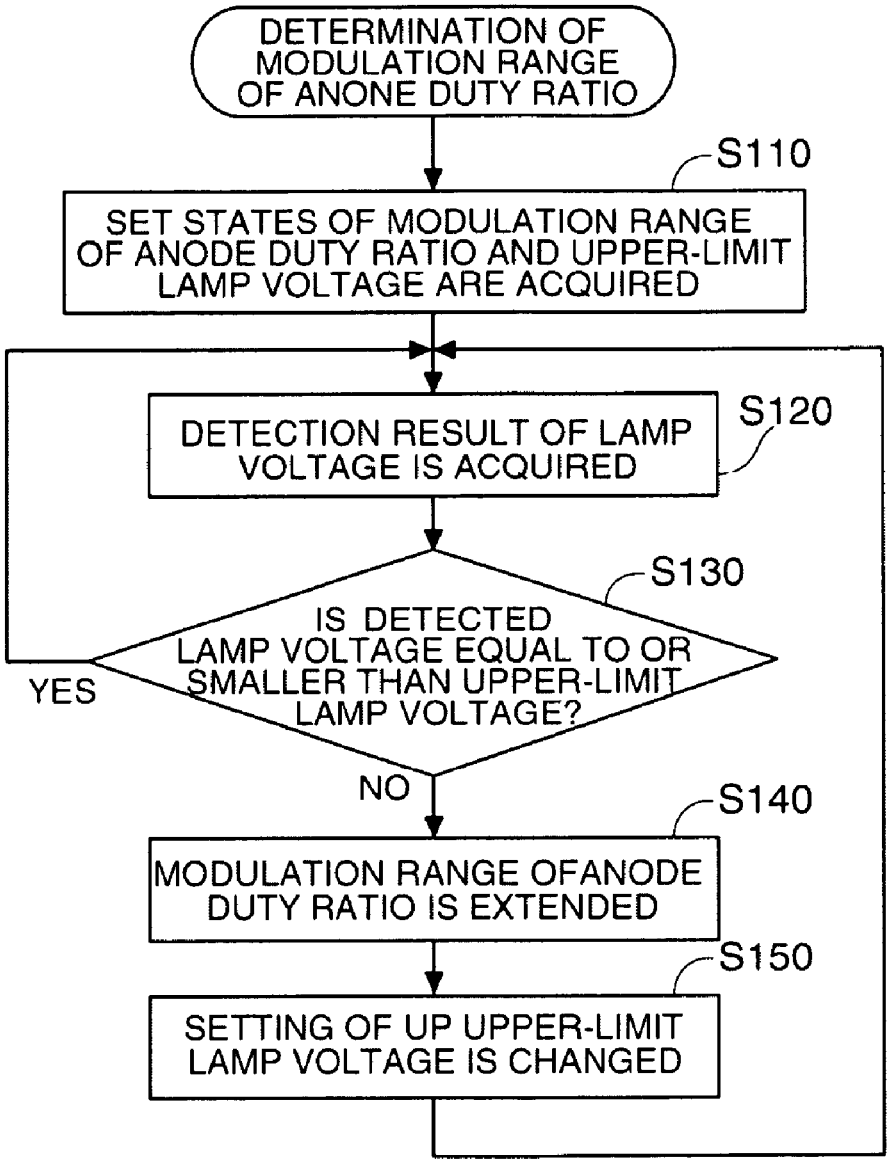
FIG. 7 is a flow chart illustrating the flow of processing when a modulation range determining portion determines a modulation range.

FIG. 7 is a flow chart illustrating the flow of processing when the modulation range determining portion 614 determines a modulation range of the anode duty ratio. This processing is always executed in the discharge lamp driving device 200 when the projector 1000 starts or while the discharge lamp 500 is lighting. However, the processing for determining the modulation range does not necessarily need to be executed all the time. For example, the processing for determining the modulation range may also be executed when the CPU 610 receives an interval signal by configuring the timer 640 (FIG. 3) to generate the interval signal whenever a predetermined lighting time (for example, 10 hours) of the discharge lamp 500 elapses.

In step S110, the modulation range determining portion 614 acquires set states of a modulation range of an anode duty ratio and an upper limit (upper-limit lamp voltage) of a lamp voltage. The set states may be acquired, for example, by referring to a memory (not shown) included in the driving control unit 210. Then, in step S120, the modulation range determining portion 614 acquires the lamp voltage (detection lamp voltage) that the CPU 610 has acquired through the input port 660.

In step S130, the modulation range determining portion 614 determines whether or not the acquired detection lamp voltage is equal to or smaller than the upper-limit lamp voltage. When the detection lamp voltage exceeds the upper-limit lamp voltage, the control proceeds to step S140. On the other hand, when the detection lamp voltage is equal to or smaller than the upper-limit lamp voltage, the control returns to step S120 and the processing of steps S120 and S130 is repeatedly executed until the detection lamp voltage exceeds the upper-limit lamp voltage.

In step S140, the modulation range determining portion 614 extends the modulation range of the anode duty ratio. Subsequently, in step S150, the modulation range determining portion 614 changes setting of the upper-limit lamp voltage. After the change of setting of the upper-limit lamp voltage in step S150, the control returns to step S120 and the processing of steps S120 to S150 is repeatedly executed.

As is apparent from the flow chart shown in FIG. 7, the modulation range determining portion 614 changes the modulation range of the anode duty ratio when the detection lamp voltage exceeds the upper-limit lamp voltage. For this reason, the modulation range determining portion 614 may also be referred to as a 'modulation range changing portion' that changes the modulation range.

Figure 8:
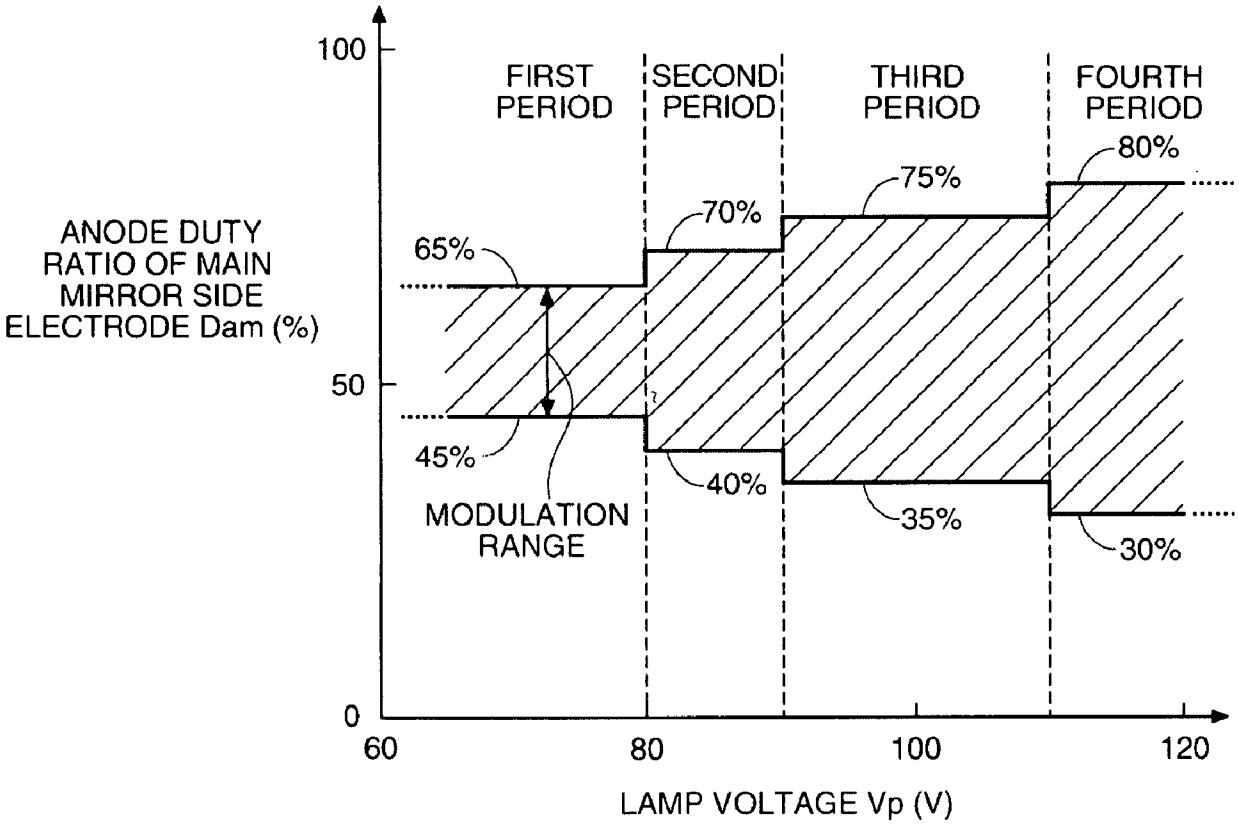
FIG. 8 is a graph illustrating how the modulation range of the anode duty ratio extends according to an increase in lamp voltage.

FIG. 8 is an explanatory view illustrating how the modulation range of the anode duty ratio extends according to an increase in lamp voltage by the modulation range determination processing shown in FIG. 7. FIG. 8 is a graph illustrating the relationship between a lamp voltage Vp and a modulation range of the anode duty ratio Dam of the main mirror side electrode 532. In the example shown in FIG. 8, in the initial state of the discharge lamp 500, the upper-limit lamp voltage is set to 80 V and the modulation range of the anode duty ratio Dam of the main mirror side electrode 532 is set to a range of 45% to 65%. Accordingly, in a first period until the lamp voltage Vp reaches 80 V from the initial state (about 65 V), the modulation range of the anode duty ratio Dam of the main mirror side electrode 532 is set between 45% and 65%.

When the lamp voltage Vp gradually rises with lighting of the discharge lamp 500 to exceed the upper-limit lamp voltage (80 V) of the first period, the modulation range of the anode duty ratio Dam of the main mirror side electrode 532 extends in step S140 of FIG. 7 and the upper-limit lamp voltage changes in step S150. Specifically, as shown in FIG. 8, in a second period for which the detection lamp voltage Vp exceeds 80 V, the modulation range of the anode duty ratio Dam of the main mirror side electrode 532 changes to a range of 40% to 70%. Moreover, the upper-limit lamp voltage is set to 90 V in the second period.

In a third period for which the lamp voltage Vp further exceeds the upper-limit lamp voltage (90 V) of the second period, the modulation range of the anode duty ratio Dam of the main mirror side electrode 532 further extends to be set to a range of 35% to 75%. In addition, the upper-limit lamp voltage is set to 110 V. Similarly, in a fourth period for which the lamp voltage Vp exceeds the upper-limit lamp voltage (110 V) of the third period, the modulation range of the anode duty ratio Dam of the main mirror side electrode 532 is set to a range of 30% to 80%.

As shown in FIG. 8, in the first example, when the lamp voltage Vp rises to exceed the upper-limit lamp voltage, the maximum value of the anode duty ratio Dam of the main mirror side electrode 532 is set higher and the minimum value thereof is set lower. Accordingly, the anode duty ratio Das of the auxiliary mirror side electrode 542 is also set higher. However, depending on the characteristics of discharge lamps, such as the types of the discharge lamps or the shapes of discharge electrodes, the modulation ranges of the anode duty ratios Dam and Das may also be changed in patters different from the pattern shown in FIG. 8. For example, when the temperature of the auxiliary mirror side electrode 542 is difficult to rise excessively and an electrode material of the auxiliary mirror side electrode 542 is difficult to evaporate due to the shape, material, or other environmental factors, the maximum value of the anode duty ratio Das of the auxiliary mirror side electrode 542 may be further increased. On the contrary, when the temperature of the main mirror side electrode 532 is difficult to fall excessively and an electrode material of the main mirror side electrode 532 easily evaporates due to the shape, material, or other environmental factors, the maximum value of the anode duty ratio Dam of the main mirror side electrode 532 may not be increased. In general, the anode duty ratios Dam and Das of at least one of the two discharge electrodes 532 and 542 are preferably set high within the modulation period Tm.

Figure 9:
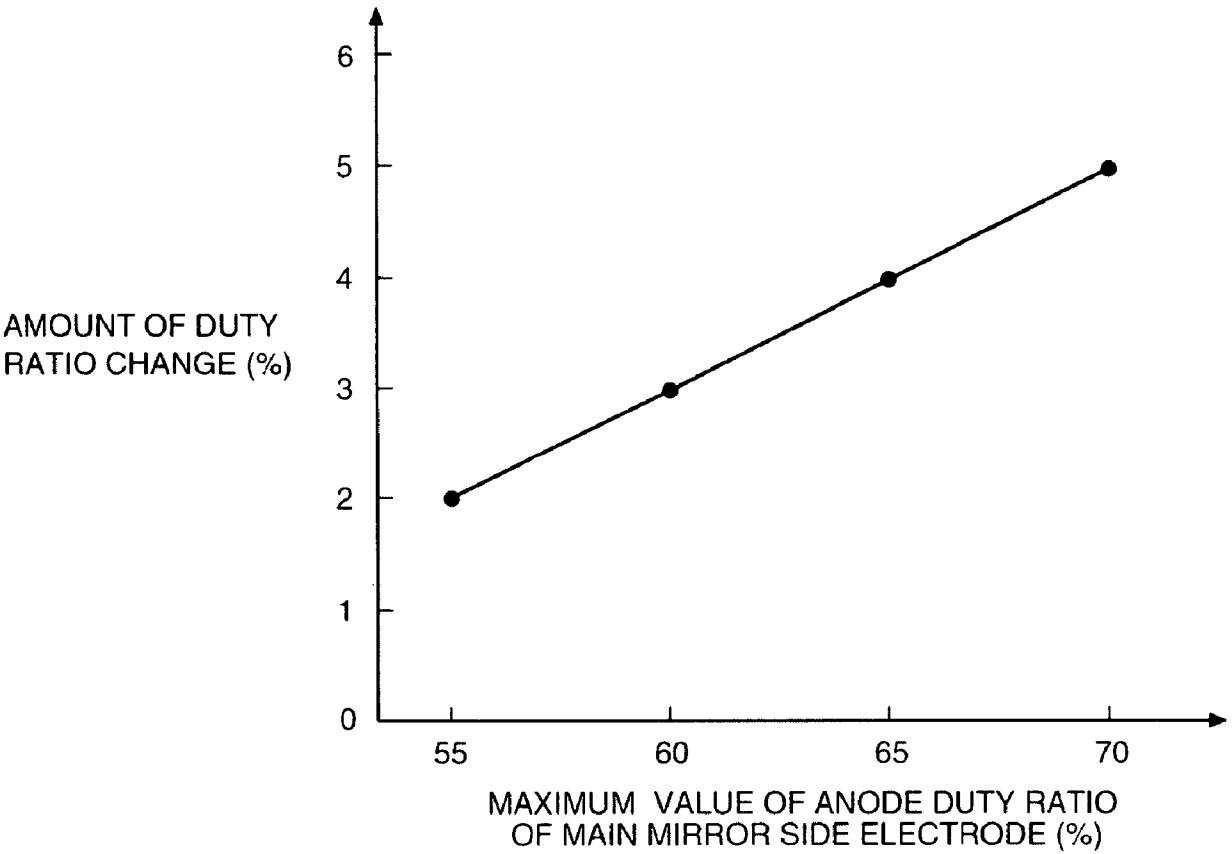
FIG. 9 is an explanatory view illustrating the relationship between a maximum value of an anode duty ratio of a main mirror side electrode and the amount of change of anode duty ratio.

FIG. 9 is a graph illustrating the relationship between a maximum value of the anode duty ratio of the main mirror side electrode 532 and a change width of anode duty ratio (amount of duty ratio change) for every step time Ts (FIG. 4). In the first example, as shown in FIG. 9, the amount of duty ratio change for every step time Ts is set high in order to make the maximum value of the anode duty ratio high.

Figure 10:
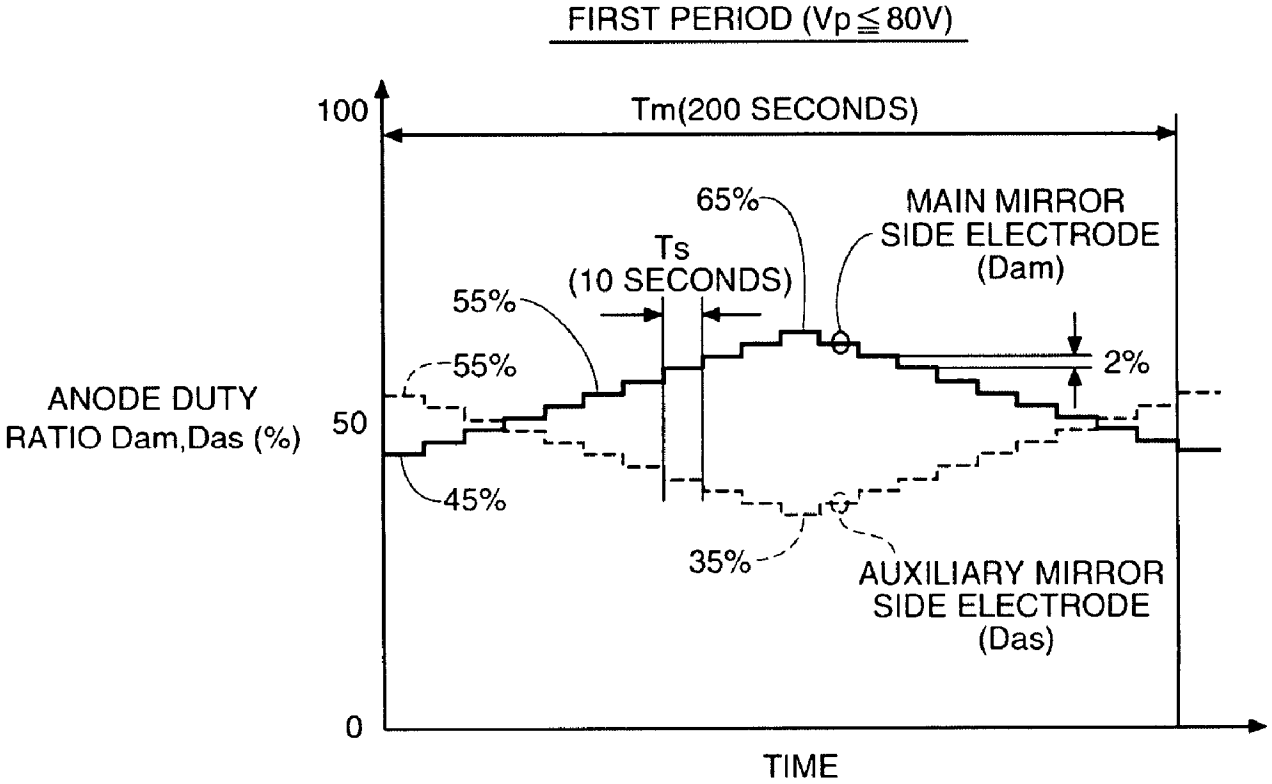
FIG. 10 is an explanatory view illustrating how the anode duty ratio is modulated in a first period.

FIG. 10 is an explanatory view illustrating how the anode duty ratio is modulated in the first period shown in FIG. 8. FIG. 10 is almost the same as FIG. 5A. As shown in FIG. 10, the anode duty ratio Dam of the main mirror side electrode 532 is modulated in a range of 45% to 65% in the first period. Accordingly, the anode duty ratio Das of the auxiliary mirror side electrode 542 is modulated in a range of 35% to 55% within the modulation period Tm. The anode duty ratio changes 2% for every step time (10 seconds) corresponding to 1/20 of the modulation period Tm (200 seconds).

Figure 11:
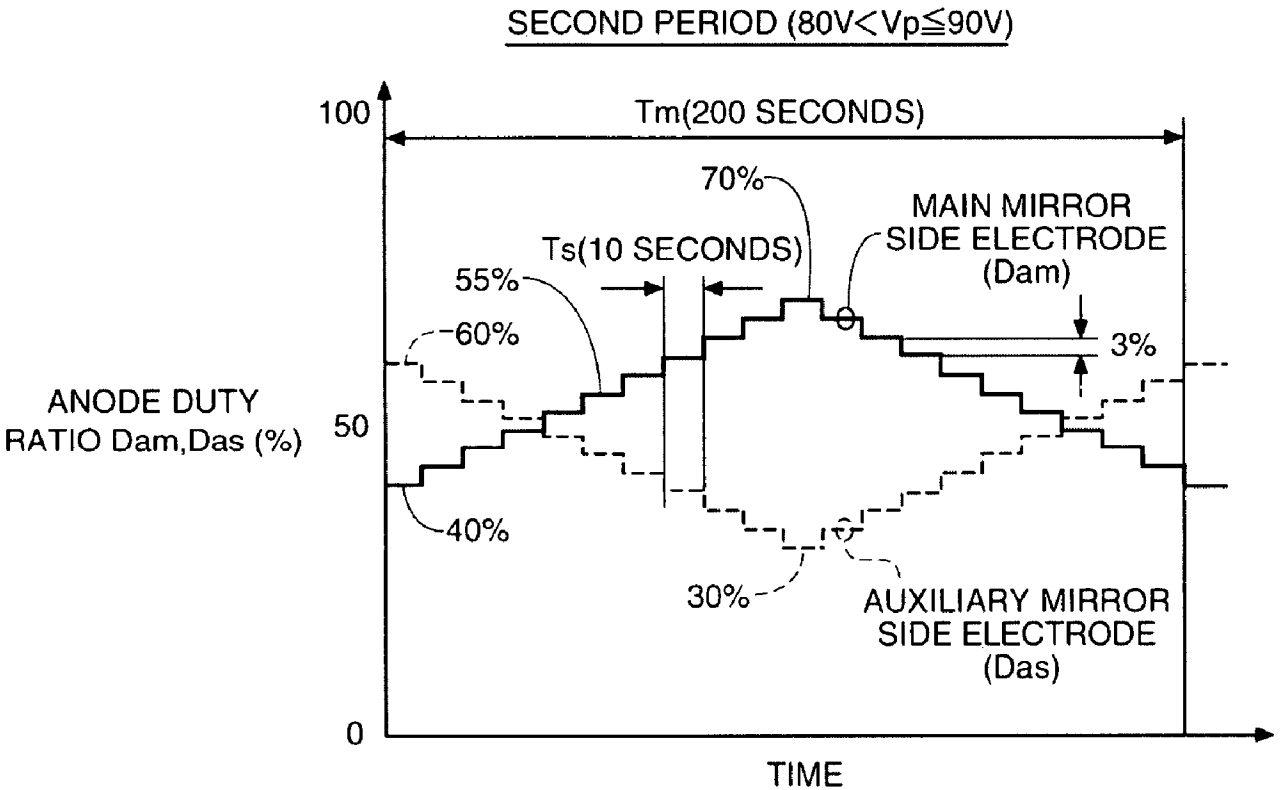
FIG. 11 is an explanatory view illustrating how the anode duty ratio is modulated in a second period.

FIG. 11 is an explanatory view illustrating how the anode duty ratio is modulated in the second period shown in FIG. 8. FIG. 11 is different from FIG. 10 in that the modulation range of the anode duty ratio is wider than that in FIG. 10. The other points are the same as in FIG. 10.

As shown in FIG. 11, the anode duty ratio Dam of the main mirror side electrode 532 is modulated in a range of 40% to 70% in the second period. Accordingly, the anode duty ratio Das of the auxiliary mirror side electrode 542 is modulated in a range of 30% to 60% within the modulation period Tm. Similar to the first period, the anode duty ratio changes for every step time (10 seconds) corresponding to 1/20 of the modulation period Tm (200 seconds). However, as shown in FIG. 9, the amount of duty ratio change (3%) is higher than that in the first period (2%) in order to set the maximum value of the anode duty ratio Dam of the main mirror side electrode 532 to 70% higher than that in the first period.

Figure 12:
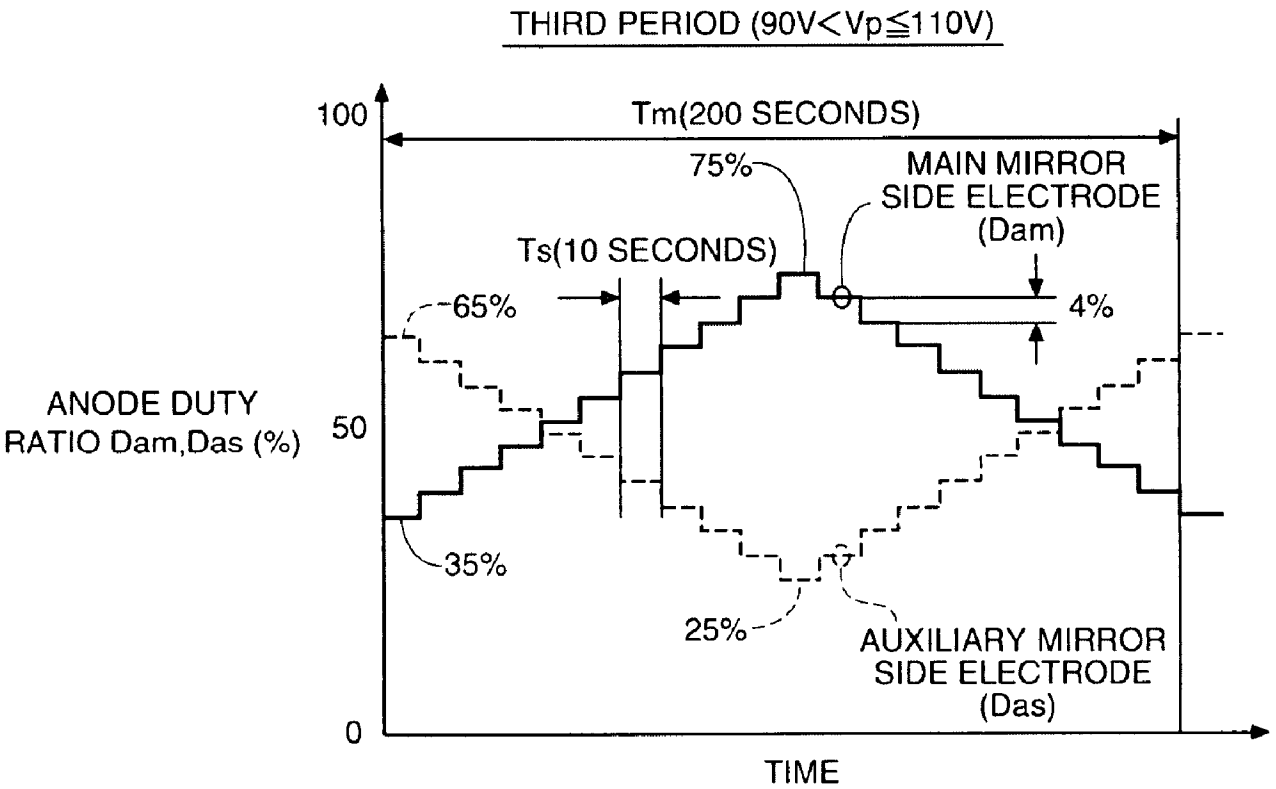
FIG. 12 is an explanatory view illustrating how the anode duty ratio is modulated in a third period.
Figure 13:
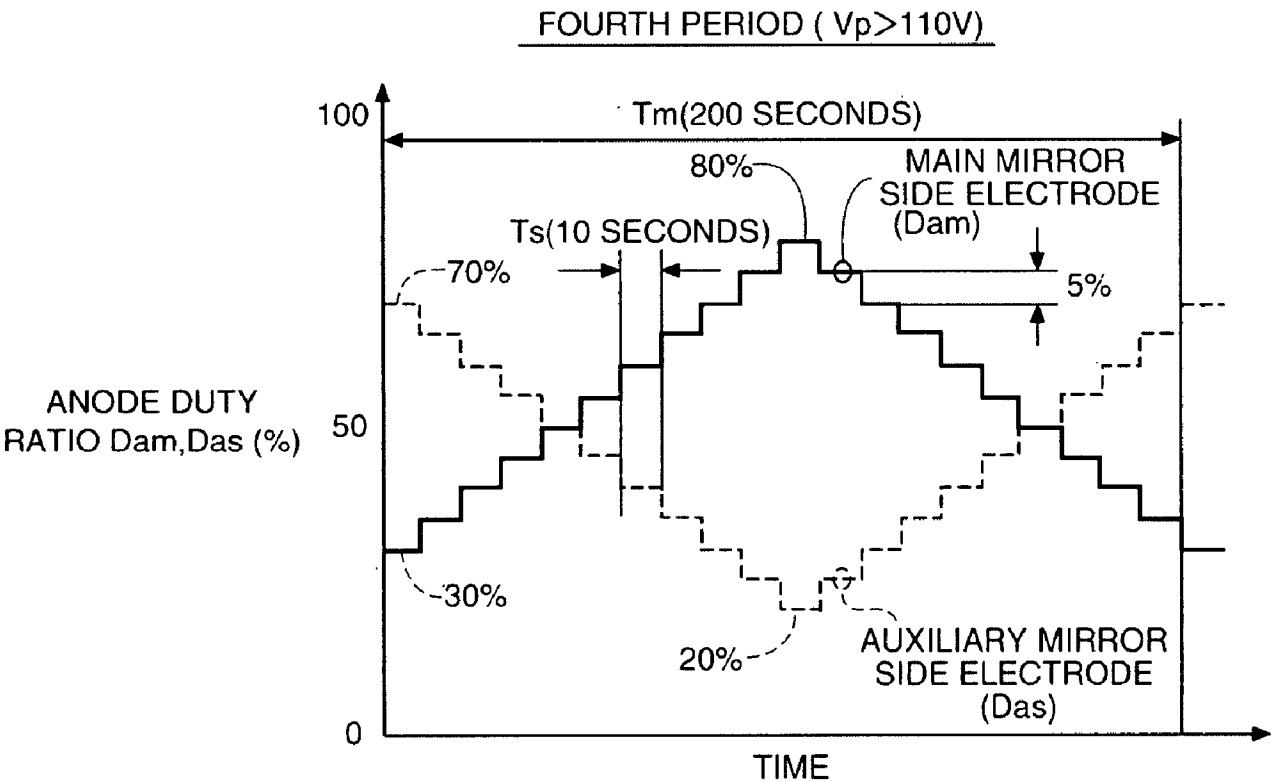
FIG. 13 is an explanatory view illustrating how the anode duty ratio is modulated in a fourth period.

FIGS. 12 and 13 are explanatory views illustrating how the anode duty ratio is modulated in the third and fourth periods shown in FIG. 8. FIGS. 12 and 13 are different from FIG. 10 in that the modulation ranges of the anode duty ratios Dam and Das are changed. The other points are the same as in FIG. 10. As shown in FIGS. 12 and 13, the modulation ranges of the anode duty ratios Dam and Das are extended by setting the amount of duty ratio change for every step time Ts to 4% and 5% in the third and fourth periods, respectively.

FIGS. 14A to 14D are explanatory views illustrating how an increase in the anode duty ratio affects the discharge electrode. FIGS. 14A and 14B illustrate the appearance of the main mirror side electrode 532 in a state where the main mirror side electrode 532 operates as an anode. FIG. 14C is a graph illustrating a temporal change of an operating state of the main mirror side electrode 532. FIG. 14D is a graph illustrating a temporal change of the temperature of the main mirror side electrode 532.

As shown in FIGS. 14A and 14B, when the main mirror side electrode 532 operates as an anode, electrons are emitted from the auxiliary mirror side electrode 542 to collide with the main mirror side electrode 532. By the collision of electrons, the kinetic energy of electrons is converted into the heat energy in the main mirror side electrode 532 on the anode side. As a result, the temperature of the main mirror side electrode 532 rises. On the other hand, since the collision of electrons does not occur in the auxiliary mirror side electrode 542 on the cathode side, the temperature of the auxiliary mirror side electrode 542 decreases due to heat conduction, emission, and the like. Similarly, in a period for which the main mirror side electrode 532 operates as a cathode, the temperature of the main mirror side electrode 532 falls and the temperature of the auxiliary mirror side electrode 542 rises.

Accordingly, if the anode duty ratio of the main mirror side electrode 532 is made high as shown in FIG. 14C, a period for which the temperature of the main mirror side electrode 532 rises becomes long and a period for which the temperature of the main mirror side electrode 532 falls becomes short as shown in FIG. 14D. By setting the anode duty ratio of the main mirror side electrode 532 high as described above, the highest temperature of the main mirror side electrode 532 is increased. When the highest temperature of the main mirror side electrode 532 is increased, a melted portion MR formed by melting of the electrode material is generated at the tip of a projection 538*b* as shown in FIG. 14B. The melted portion MR formed by melting of the electrode material has a dome shape due to the surface tension. Therefore, as shown in FIG. 14A, the dome-like projection 538*b* is formed again from the projection 538*a* with a flat tip.

In the first example, as shown in FIG. 8, the maximum value of the anode duty ratio of the main mirror side electrode 532 is set to be higher than that in the first period as the lamp voltage Vp rises. Thus, by setting the anode duty ratio of the main mirror side electrode 532 in the second to fourth periods, in which the lamp voltage Vp has increased, to be higher than that in the initial first period, the dome-like projection 538*b* is formed again from the projection 538*a* (FIG. 14A) made flat by lighting of the discharge lamp 500. Moreover, as shown in FIG. 8, in the second to fourth periods, the minimum value of the anode duty ratio of the main mirror side electrode 532 is set to be lower than that in the first period. Accordingly, a maximum value of an anode duty ratio of a second discharge electrode in the second to fourth periods is also set to be higher than that in the first period, such that a dome-like projection is also formed again in the auxiliary mirror side electrode 542.

In general, when the tips of the projections 538 and 548 are made flat, the position where arc occurs becomes unstable. As a result, a possibility that the position of arc will move during lighting, that is, a possibility of so-called arc jump increases. In the first example, as shown in FIG. 6B, when the tips of the projections 538*a* and 548*a* become flat to cause the lamp voltage to rise, the maximum values of the anode duty ratios of the discharge electrodes 532 and 542 are set to higher values. Accordingly, when the dome-like projection 538*b* is formed again as shown in FIG. 14B, arc occurs stably between the tips of the projections.

Thus, in the first example, the modulation range of the anode duty ratio is extended such that both maximum values of the anode duty ratios Dam and Das of the two discharge electrodes 532 and 542 increase as the lamp voltage rises. Accordingly, re-formation of a projection is accelerated for the discharge lamp 500 that has deteriorated, and the progress of deterioration caused by an excessive temperature increase in the discharge electrodes 532 and 542 is suppressed for the discharge lamp 500 that has not deteriorated yet. As a result, it becomes easy to make the discharge lamp 500 light stably over a longer period of time.

B. Second Example

Figure 15:
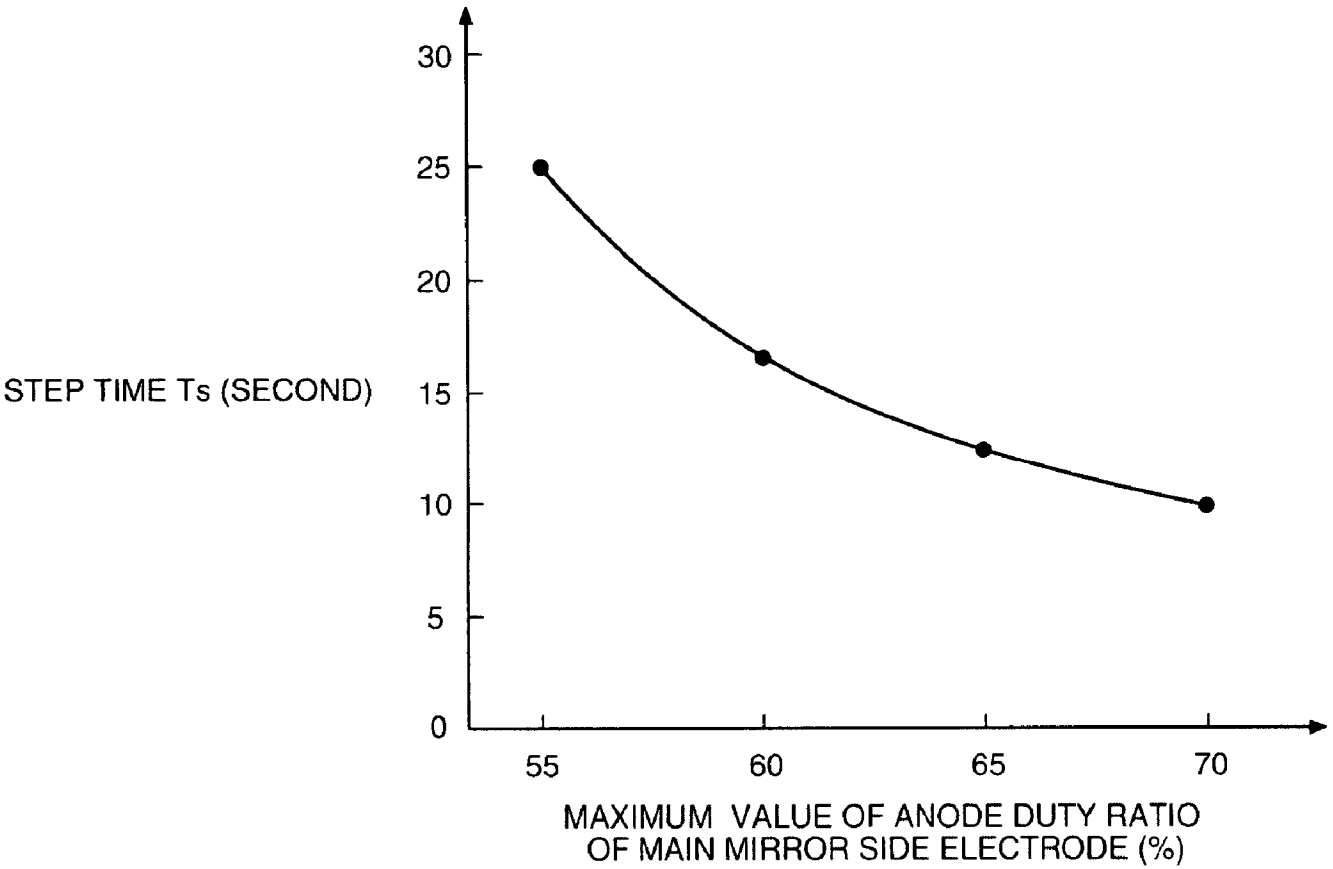
FIG. 15 is an explanatory view illustrating the relationship between a maximum value of an anode duty ratio of a main mirror side electrode and a step time in a second example.

FIG. 15 is an explanatory view illustrating the relationship between a maximum value of an anode duty ratio of the main mirror side electrode 532 and a time interval (that is, step time Ts) in which the anode duty ratio changes in a second example. The second example is different from the first example, in which the maximum values of the anode duty ratios Dam and Das are changed by changing the amount of duty ratio change while keeping the step time Ts constant, in a point that the maximum values of the anode duty ratios Dam and Das are changed by changing the step time Ts while keeping the amount of duty ratio change constant. The other points are the same as in the first example.

FIGS. 16 to 19 are explanatory views illustrating how the anode duty ratio is modulated in the second example. FIGS. 16 to 19 are graphs illustrating temporal changes of the anode duty ratios Dam and Das in the first to fourth periods shown in FIG. 8, respectively.

Figure 16:
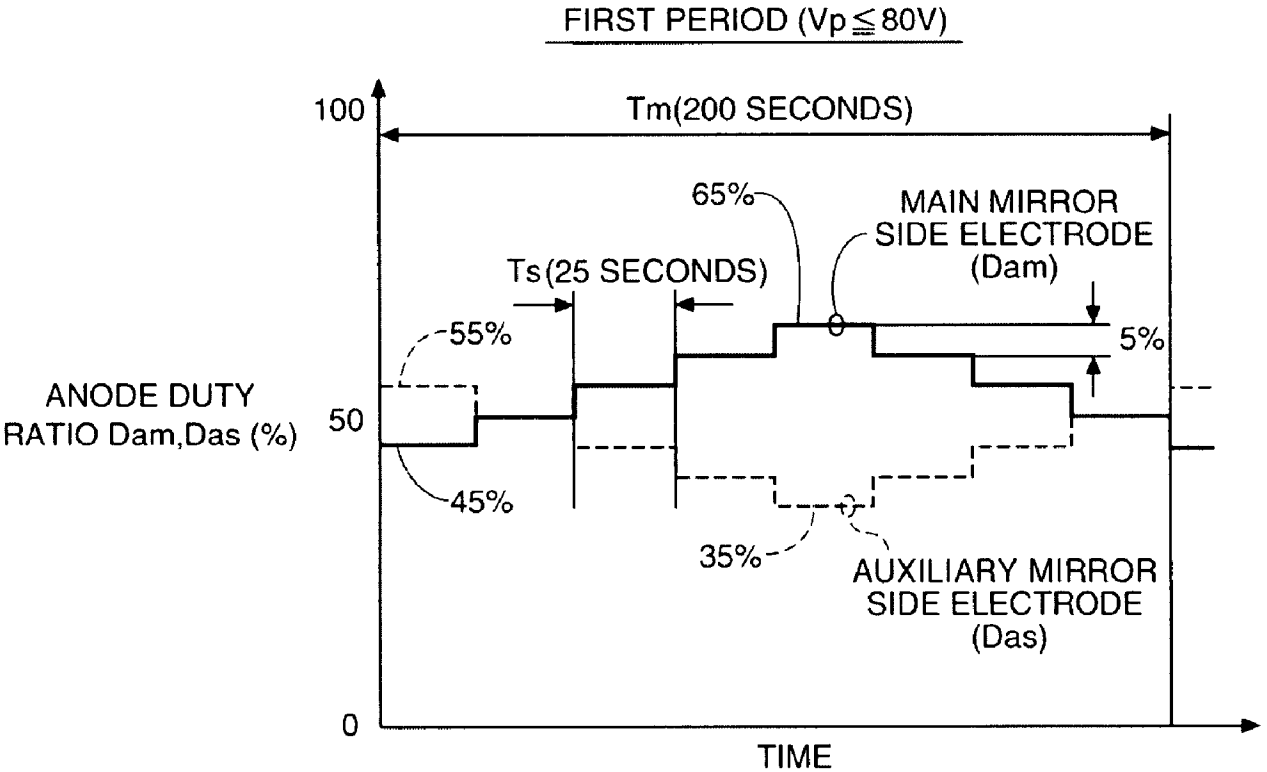
FIG. 16 is an explanatory view illustrating how the anode duty ratio is modulated in the first period.

As shown in FIG. 16, in the first period (refer to FIG. 8), the step time Ts is set to 25 seconds and the amount of duty ratio change is set to 5%. Accordingly, in the first period, the anode duty ratio Dam of the main mirror side electrode 532 is modulated in a range of 45% to 65% and the anode duty ratio Das of the auxiliary mirror side electrode 542 is modulated in a range of 35% to 55%.

Figure 17:
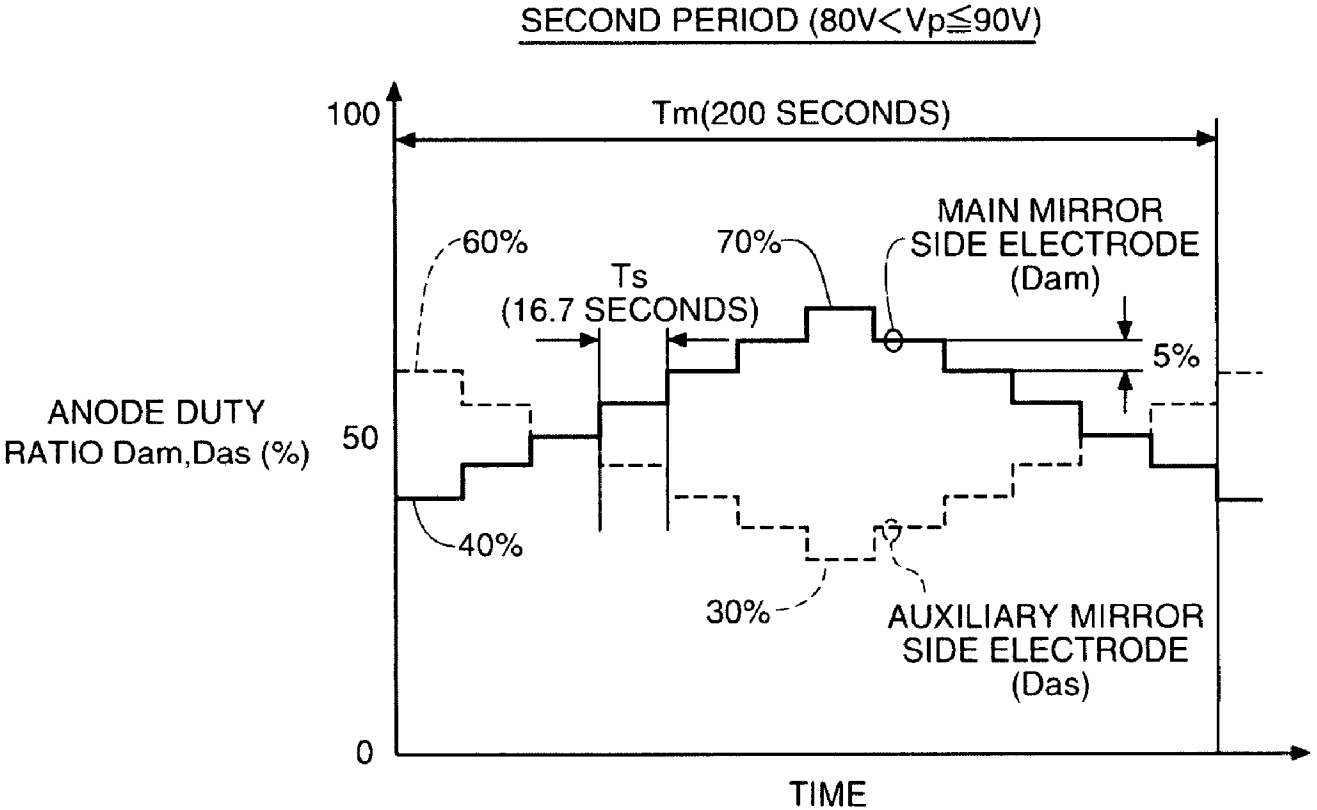
FIG. 17 is an explanatory view illustrating how the anode duty ratio is modulated in the second period.

Subsequently, in the second period for which the lamp voltage exceeds 80 V, the step time Ts is set to about 16.7 seconds (50/3 seconds) as shown in FIG. 17. Moreover, the amount of duty ratio change is set to 5% which is the same as that in the first period. Accordingly, in the second period, the anode duty ratio Dam of the main mirror side electrode 532 is modulated in a range of 40% to 70% and the anode duty ratio Das of the auxiliary mirror side electrode 542 is modulated in a range of 30% to 60%.

Figure 18:
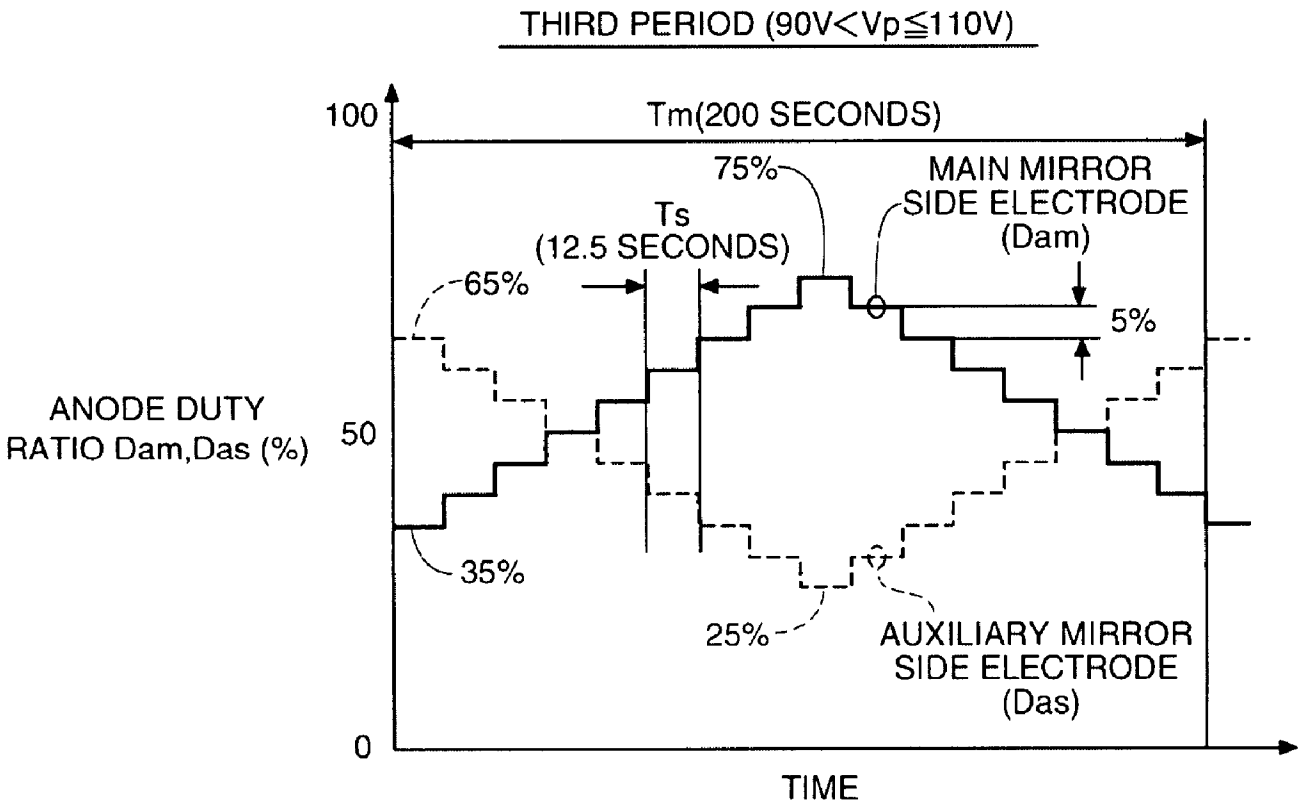
FIG. 18 is an explanatory view illustrating how the anode duty ratio is modulated in the third period.

In the third period for which the lamp voltage exceeds 90 V, the step time Ts is set to 12.5 seconds as shown in FIG. 18. Moreover, the amount of duty ratio change is set to 5% which is the same as that in the first period. Accordingly, in the third period, the anode duty ratio Dam of the main mirror side electrode 532 is modulated in a range of 35% to 75% and the anode duty ratio Das of the auxiliary mirror side electrode 542 is modulated in a range of 25% to 65%.

Figure 19:
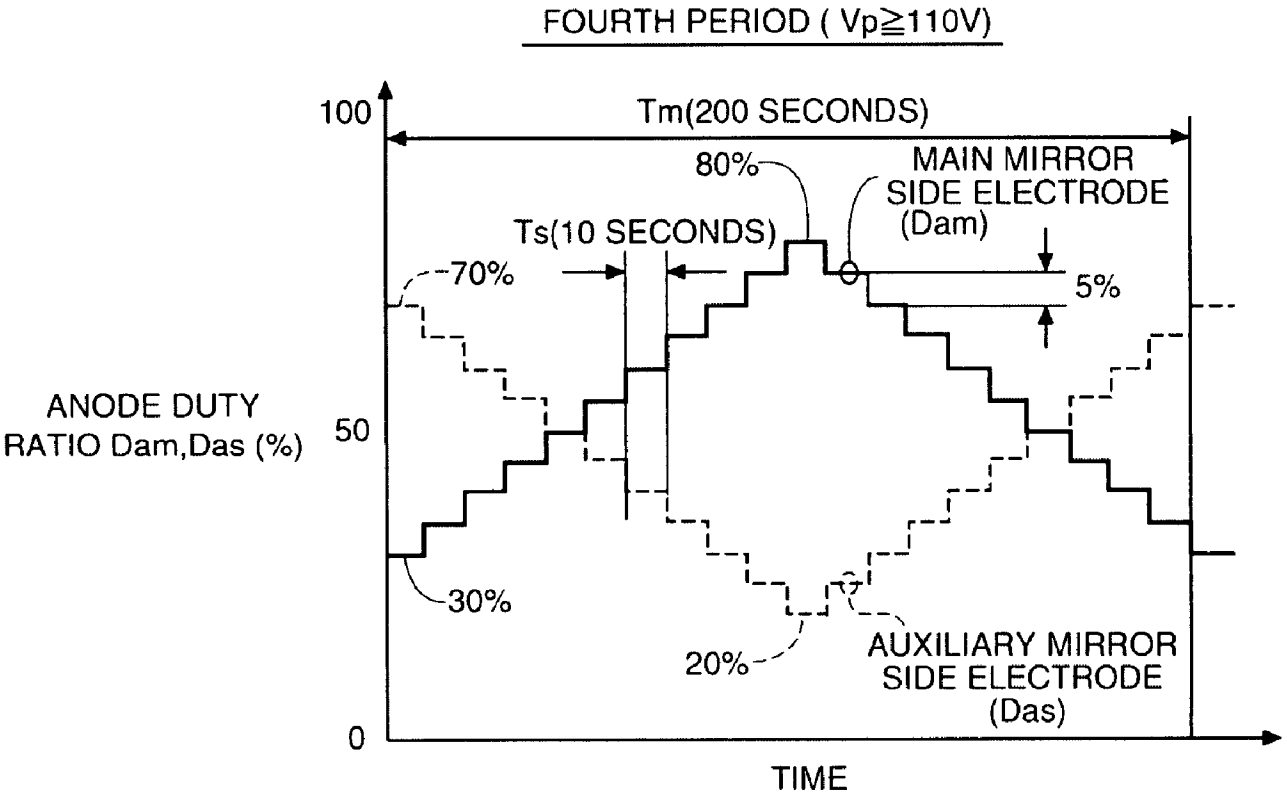
FIG. 19 is an explanatory view illustrating how the anode duty ratio is modulated in the fourth period.

Then, in the fourth period for which the lamp voltage exceeds 110 V, the step time Ts is set to 10 seconds as shown in FIG. 19. Moreover, the amount of duty ratio change is set to 5% which is the same as that in the first period. Accordingly, in the fourth period, the anode duty ratio Dam of the main mirror side electrode 532 is modulated in a range of 30% to 80% and the anode duty ratio Das of the auxiliary mirror side electrode 542 is modulated in a range of 20% to 70%.

Thus, in the second example, when the lamp voltage rises, the number of times of duty ratio change within the modulation period Tm is increased by shortening the step time Ts while keeping the amount of duty ratio change constant. Then, the maximum values of the anode duty ratios Dam and Das are set to be higher according to an increase of the lamp voltage, similar to the first example. Accordingly, also in the second example, re-formation of a projection is accelerated for the discharge lamp 500 that has deteriorated, and the progress of deterioration caused by an excessive temperature increase in the discharge electrodes 532 and 542 is suppressed for the discharge lamp 500 that has not deteriorated yet. As a result, it becomes easy to make the discharge lamp 500 light stably over a longer period of time.

Furthermore, in the second example, the step time is shortened in a state where the modulation range of the anode duty ratio is wide. Accordingly, since a period for which the anode duty ratio is high is shortened, an excessive temperature increase in the discharge electrodes 532 and 542 can be suppressed.

C. Modifications

In addition, the invention is not limited to the above-described examples and embodiments, but various modifications may be made within the scope without departing from the subject matter or spirit of the invention. For example, the following modifications may also be made.

C1. First Modification

A deterioration state of the discharge lamp 500 is detected using the lamp voltage in the above examples. However, the deterioration state of the discharge lamp 500 may also be detected in other methods. For example, the deterioration state of the discharge lamp 500 may be detected on the basis of occurrence of the arc jump caused by flattening of the projections 538*a* and 548*a* (FIGS. 6A and 6B). Alternatively, the deterioration state of the discharge lamp 500 may be detected on the basis of a decrease in the amount of light caused by deposition of an electrode material on the inner wall of the discharge space 512 (FIG. 2). The occurrence of arc jump or the decrease in the amount of light may be detected using an optical sensor, such as a photodiode, disposed adjacent to the discharge lamp 500.

C2. Second Modification

In the above examples, the lamp voltage, that is, the deterioration state of the discharge lamp 500 is detected and the modulation range of the anode duty ratio is changed on the basis of the detection result as shown in FIG. 8. However, the modulation range may also be changed on the basis of other conditions. For example, the modulation range of the anode duty ratio may be changed when the cumulative lighting time of the discharge lamp 500 measured by the timer 640 exceeds a predetermined reference time (for example, 500 hours). In this manner, an excessive temperature increase in a discharge electrode that has not deteriorated yet is suppressed, and formation of a projection is accelerated for a discharge electrode that has deteriorated. As a result, it becomes easy to make the discharge lamp 500 light stably over a longer period of time. In this case, the predetermined reference time may be suitably set on the basis of the life of the discharge lamp 500, an experiment on the progress of deterioration of the discharge electrode, and the like.

C3. Third Modification

In the above examples, the liquid crystal light valves 330R, 330G, and 330B are used as light modulating units in the projector 1000 (FIG. 1). However, other arbitrary modulating units, such as a DMD (digital micromirror device; trademark of Texas Instruments, Inc.), may also be used as the light modulating units. In addition, the invention may also be applied to various kinds of image display devices including a liquid crystal display device, exposure devices, or illuminating devices as long as these devices use discharge lamps as light sources.

The entire disclosure of Japanese Patent Application No. 2008-39910, filed Feb. 21, 2008 is expressly incorporated by reference herein.

What is claimed is:

1. A driving method for a discharge lamp that lights by performing discharge between two electrodes while alternately switching a polarity of a voltage applied between the two electrodes, comprising:

modulating an anode duty ratio, which is a ratio of an anode time for which one of the electrodes operates as an anode in one period of the polarity switching, within a predetermined range; and changing the predetermined range to make a maximum value of the modulated anode duty ratio higher than a maximum value of an initial anode duty ratio of the discharge lamp when a predetermined condition is satisfied.

2. The driving method for a discharge lamp according to claim 1, wherein in the modulation of the anode duty ratio, a change width of the anode duty ratio per change of the anode duty ratio is constant, and when the predetermined condition is satisfied, the maximum value of the anode duty ratio is increased by increasing the number of times of change for increasing the anode duty ratio in one modulation period for which the modulation is performed.

3. The driving method for a discharge lamp according to claim 1, wherein the discharge lamp has a condition in which an operating temperature of one of the two electrodes is higher than that of the other electrode, and an anode duty ratio in the one electrode is set to be lower than that in the other electrode.

4. The driving method for a discharge lamp according to claim 3, wherein the discharge lamp has a reflecting mirror that reflects light emitted between the electrodes toward the other electrode side.

5. The driving method for a discharge lamp according to claim 1, wherein the predetermined condition is satisfied when a cumulative lighting time of the discharge lamp exceeds a predetermined reference time.

6. The driving method for a discharge lamp according to claim 1, further comprising:

detecting a deterioration state of the electrode according to the use of the discharge lamp; and determining whether or not the predetermined condition is satisfied on the basis of the deterioration state.

7. The driving method for a discharge lamp according to claim 6, wherein the deterioration state is detected on the basis of a voltage applied between the two electrodes in supplying predetermined power between the two electrodes.

8. The driving method for a discharge lamp according to claim 1, wherein the period of the polarity switching is maintained as a constant value within one modulation period for which the modulation is performed.

9. A driving device for a discharge lamp, comprising:

a discharge lamp lighting unit that makes the discharge lamp light by supplying the power between two electrodes of the discharge lamp; and a power supply control unit that controls a power supply state of the discharge lamp lighting unit, the discharge lamp lighting unit includes a polarity switching portion that alternately switches a polarity of a voltage applied between the electrodes, and the power supply control unit includes:

an anode duty ratio modulating portion that modulates an anode duty ratio, which is a ratio of an anode time for which one of the electrodes operates as an anode in one period of the polarity switching, within a predetermined range; and a modulation range changing portion that changes the predetermined range to make a maximum value of the modulated anode duty ratio higher than a maximum value of an initial anode duty ratio of the discharge lamp when a predetermined condition is satisfied.

10. A light source device, comprising:

a discharge lamp;

a discharge lamp lighting unit that makes the discharge lamp light by supplying the power between two electrodes of the discharge lamp; and a power supply control unit that controls a power supply state of the discharge lamp lighting unit, the discharge lamp lighting unit includes a polarity switching portion that alternately switches a polarity of a voltage applied between the electrodes, and the power supply control unit includes:

an anode duty ratio modulating portion that modulates an anode duty ratio, which is a ratio of an anode time for which one of the electrodes operates as an anode in one period of the polarity switching, within a predetermined range; and a modulation range changing portion that changes the predetermined range to make a maximum value of the modulated anode duty ratio higher than a maximum value of an initial anode duty ratio of the discharge lamp when a predetermined condition is satisfied.

11. An image display device, comprising:

a discharge lamp as a light source for image display;

a discharge lamp lighting unit that makes the discharge lamp light by supplying the power between two electrodes of the discharge lamp; and a power supply control unit that controls a power supply state of the discharge lamp lighting unit, the discharge lamp lighting unit includes a polarity switching portion that alternately switches a polarity of a voltage applied between the electrodes, and the power supply control unit includes:

an anode duty ratio modulating portion that modulates an anode duty ratio, which is a ratio of an anode time for which one of the electrodes operates as an anode in one period of the polarity switching, within a predetermined range; and a modulation range changing portion that changes the predetermined range to make a maximum value of the modulated anode duty ratio higher than a maximum value of an initial anode duty ratio of the discharge lamp when a predetermined condition is satisfied.

* * * * *